United States Patent [19]

Nilsson

[11] Patent Number: 5,034,099

[45] Date of Patent: Jul. 23, 1991

[54] APPARATUS FOR THE MANUFACTURE OF FIBER PULP USING A PREHEATER, DEFIBRATOR AND HORIZONTAL SEPARATOR

[75] Inventor: Kjell R. S. Nilsson, Sao Martinho do Porto, Portugal

[73] Assignee: Sunds Defibrator Aktiebolag, Sweden

[21] Appl. No.: 399,529

[22] PCT Filed: Apr. 11, 1988

[86] PCT No.: PCT/SE88/00182

§ 371 Date: Aug. 23, 1989

§ 102(e) Date: Aug. 23, 1989

[87] PCT Pub. No.: WO88/08050

PCT Pub. Date: Oct. 20, 1988

[30] Foreign Application Priority Data

Apr. 15, 1987 [SE] Sweden ..... 8701573-1

[51] Int. Cl.[5] ..... D21C 1/12; D21C 1/14

[52] U.S. Cl. ..... 162/261; 162/23; 162/46; 55/191

[58] Field of Search ..... 162/28, 46, 47, 23, 162/68, 55, 261; 55/191; 241/28

[56] References Cited

U.S. PATENT DOCUMENTS

| | | | |
|---|---|---|---|
| 4,136,831 | 1/1979 | Cederquist et al. | 241/18 |
| 4,283,252 | 8/1981 | Reinhall | 162/23 |
| 4,326,913 | 4/1982 | Mattsson | 162/46 |
| 4,350,499 | 9/1982 | Lundgren | 55/1 |
| 4,457,804 | 7/1984 | Reinhall | 162/254 |

FOREIGN PATENT DOCUMENTS

| | | | |
|---|---|---|---|
| 1101357 | 5/1981 | Canada . | |
| 58171 | 8/1990 | Finland . | |
| 83/02788 | 8/1983 | PCT Int'l Appl. . | |
| 417130 | 2/1981 | Sweden . | |
| 420224 | 9/1981 | Sweden . | |
| 422340 | 3/1982 | Sweden . | |
| 444588 | 4/1986 | Sweden . | |
| 84/04113 | 10/1984 | World Int. Prop. O. | 162/28 |

*Primary Examiner*—Steve Alvo

*Attorney, Agent, or Firm*—Lerner, David, Littenberg, Krumholz & Mentlik

[57] ABSTRACT

Apparatus for manufacturing pulp fiber from lignocellulose-containing material is disclosed, including a preheater, a defibrator with a pressurized housing, a conveying screw to convey the preheated lignocellulose-containing material from the preheater to the defibrator, a horizontal separator, a blow pipe for transferring the defibrated lignocellulose-containing material and steam from the defibrator to the horizontal separator, in which the horizontal separator includes a pulp outlet, a steam outlet, and a screw conveyor which includes screw threads which have a screw thread angle which substantially corresponds to the angle at which the blow pipe enters the horizontal separator. The screw conveyor in the horizontal separator feeds the defibrated lignocellulose-containing material from the blow pipe to the pulp outlet in the form of a pulp plug which maintains the pressure within the separator, and a steam transfer line is provided transferring the separated steam from the steam outlet to the preheater. The flow resistance in the blow pipe and the steam transfer line is less than the flow resistance in the screw conveyor between the preheater and the defibrator so that the steam flows from the defibrator to the horizontal separator and to the preheater. Methods for manufacturing pulp fiber from lignocellulose-containing materials utilizing this apparatus are also disclosed.

5 Claims, 2 Drawing Sheets

APPARATUS FOR THE MANUFACTURE OF FIBER PULP USING A PREHEATER, DEFIBRATOR AND HORIZONTAL SEPARATOR

FIELD OF THE INVENTION

The present invention relates to apparatus for the manufacture of pulp fiber. More particularly, the present invention relates to methods for manufacturing pulp fiber, and to apparatus and methods for manufacturing pulp fiber from lignocellulose-containing materials.

BACKGROUND OF THE INVENTION

Methods and apparatus for manufacturing pulp fibers from lignocellulose-containing materials generally include preheaters for preheating chips or the like. Subsequent to the preheater, defibering apparatus is generally used for slushing and refining of the chips to form pulp while generating steam between two opposed grinding disks which are rotating relative to each other. These grinding disks are generally enclosed in a grinding housing in which an overpressure is generally maintained. The pulp so produced, together with the steam, then generally flows from the grinding housing through a blow pipe to a steam separator. From there, the pulp is fed to a further device for processing of the pulp. Because of the desirability of utilizing the energy content of the steam separated from the pulp, the steam is generally recycled to the preheater for use in heating the chips themselves. The steam separator is normally a vessel in the form of a cyclone in which the steam is removed from the top of the cyclone and the pulp is removed from the bottom of the cyclone by means of a separate, air-tight feeding-out device, such as in the form of a plug-forming screw conveyor.

In these installations a lower pressure is generally maintained in the steam separator than that in the grinding housing. In this manner, the pulp and steam flow from the grinding housing to the separator, and the separated steam can be returned to the preheater by the use of a fan or compressor so that the required steam pressure and corresponding temperature can be maintained in the preheater.

It is also possible in these installations to transfer the material from the preheater to the defibrator by means of a steam-proof conveyor. In this manner, the steam can flow from the grinding housing through the steam separator to the preheater, since the steam pressure in the grinding housing is maintained at a higher level than the pressure in the preheater without steam flowing backwards from the defibrator to the preheater. By means of these arrangements, the energy content in the developed steam can be recovered by the material in the preheater by those chips being preheated to the highest possible temperature. However, in order to do so, the required steam transport must be secured by a fan, compressor, or a steam-proof feeder to the defibrator. This additional equipment is a considerable disadvantage, since it raises the price of the installation and renders it more complicated.

SUMMARY OF THE INVENTION

In accordance with the present invention, applicant has unexpectedly discovered that it is now possible to recover the energy content of the steam separated in a steam separator without utilizing the extra equipment such as fans, compressors, or steam-proof conveyors mentioned above in these types of installations. This discovery is, in turn, based upon the fact that the steam generated during defibration and fibrillation of the fibrous material produces a pressure maximum in the grinding housing, while the whole chips fed to the preheater produces a pressure minimum, in accordance with the law of cold wall. In this manner the flow resistance in the blow pipe and in the steam passage from the steam separator to the preheater is maintained lower than that through the conveying screw for the chips located at the bottom of the preheater. It is, therefore, now possible to pressurize the system and to obtain recirculation of the steam without the use of fans, compressors, vents, and the like.

Low flow resistance in the blow pipe is obtained by making this pipe as short as possible, without employing valves, curves, or level differences therein. It is therefore particularly favorable to arrange the separator horizontally, and as close to the defibrator as possible. In this manner, the energy losses can be minimized, i.e., the maximum energy stays within the system.

In accordance with the apparatus of the present invention for manufacturing pulp fiber from lignocellulose-containing material, the apparatus includes a preheater for preheating the lignocellulose-containing material, a defibrator including a pressurized housing for defibrating the preheated lignocellulose-containing material and steam therein, conveying means for conveying the preheated lignocellulose-containing material from the preheater to the defibrator at a first predetermined flow resistance, a horizontal separator comprising an air-tight separator housing extending substantially horizontally for separating steam from the defibrated lignocellulose-containing material, a blow pipe at a second predetermined flow resistance for transferring defibrated lignocellulose-containing material and steam from the defibrator to the horizontal separator, the blow pipe entering the horizontal separator at a predetermined angle, and the horizontal separator including a pulp outlet, a steam outlet and screw conveyor means including screw threads having a screw thread angle which substantially corresponds to the predetermined angle for feeding the defibrated lignocellulose-containing material from the blow pipe to the pulp outlet in the form of a pulp plug, in order to maintain the pressure within the horizontal separator, and steam transfer means at a third predetermined flow resistance for transferring separated steam from the steam outlet to the preheater for preheating the lignocellulose-containing material therewith, the second and third predetermined flow resistances being less than the first predetermined flow resistance, whereby steam flows from the defibrator to the horizontal separator and the preheater.

In accordance with the method of the present invention, the method for manufacturing pulp fiber from lignocellulose-containing material includes feeding the lignocellulose-containing material into a preheater for preheating the lignocellulose-containing material, feeding preheated lignocellulose-containing material to a defibrator through conveying means at a first predetermined flow resistance, defibrating the preheated lignocellulose-containing material under pressure so as to produce defibrated lignocellulose-containing material and steam therein, transferring the defibrated lignocellulose-containing material and steam through a blow pipe at a second predetermined flow resistance to a horizontal separator having a pulp outlet and a steam outlet, injecting the defibrated lignocellulose-containing material and steam into the horizontal separator at a predetermined angle, separating the preheated lignocellulose-containing material and steam in the horizontal separator by feeding the lignocellulose-containing material to the pulp outlet in the form of a pulp plug so as to maintain the pressure within the horizontal separator by means of a screw conveyor including screw threads having a screw thread angle which substantially corresponds to that predetermined angle, and transferring separated steam from the steam outlet to the preheater at a third predetermined flow resistance, the second and third predetermined flow resistances being less than the first predetermined flow resistance, whereby steam flows from the defibrator to the horizontal separator and the preheater.

BRIEF DESCRIPTION OF THE DRAWINGS

The present invention may be more fully understood with reference to the following detailed description, which, in turn, makes reference to the drawings in which.

DETAILED DESCRIPTION

Figure 3:
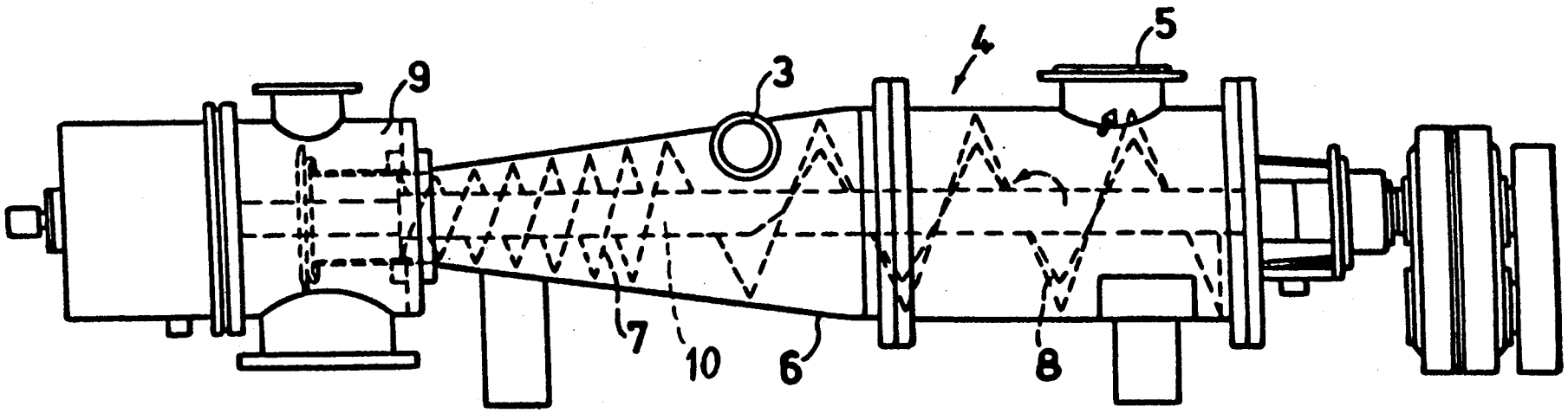
FIG. 3 is a side, elevational, partially representational view of a steam separator for use in accordance with the apparatus of the present invention.
Figure 1:
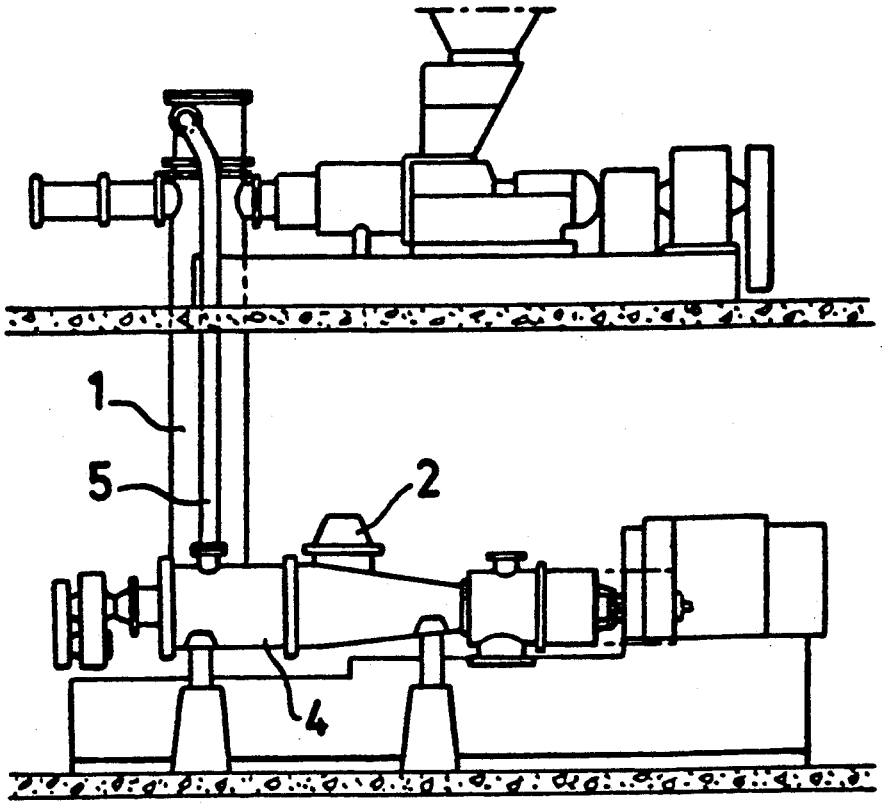
FIG. 1 is a side, elevational, partially schematic view of the apparatus of the present invention.
Figure 2:
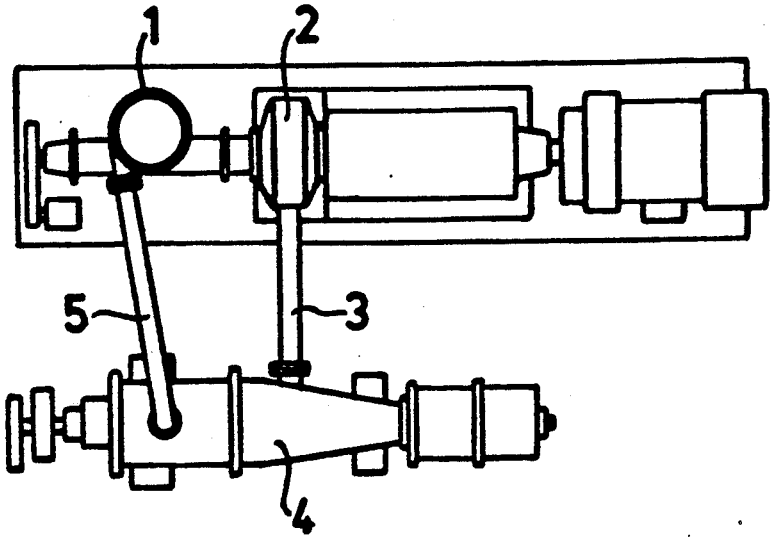
FIG. 2 is a top, elevational, partially schematic view of the apparatus of FIG. 1.

Referring to the Figures, in which like reference numerals refer to like portions thereof, FIG. 1 shows the apparatus of the present invention including a preheater 1 in which the chips are heated with steam. The preheater 1 is vertically disposed, and includes a pressure-proof feeder for cold chips at its upper end, and a conveying screw for feeding the chips to a defibrator 2 at its bottom end. The defibrator 2 comprises two opposed grinding disks, which are rotatable relative to each other, and which are enclosed by an air-tight grinding housing.

During processing of the chips in the gap between the grinding disks, a considerable amount of energy is supplied for the purpose of slushing and fibrilling the fibrous material. A large part of this energy is transformed into heat, which, in turn, causes the evaporation of water present during the defibration process. The steam which is thus generated primarily flows from the gap out into the surrounding grinding housing. A blow pipe 3 runs from the grinding housing to a steam separator 4, and the pulp and steam thus flow under pressure therethrough. The steam separator 4 is formed from an air-tight vessel 6 with a circular cross-section. The vessel 6 includes a longitudinal screw conveyor 10 with a compressing portion 7 and an open portion 8. The inlet of the blow pipe 3 into the vessel 6 is located at a position before the compressing portion 7 of the screw conveyor 10. The inlet of blow pipe 3 is preferably located tangentially with respect to the vessel 6. It is preferably configured so as to form the same angle with the axis of the screw conveyor 10 as that of the thread of the screw conveyor 10.

In the embodiment shown in the drawings, the inlet of the blow pipe is located adjacent to the transition between the compressing portion 7 and the open portion 8 of the screw conveyor 10. In the open portion 8 the separation of pulp and steam, as well as sedimentation and collection of pulp, take place. Thereafter, the pulp is fed to the compressing portion 7 where it is compressed to an air-tight plug and discharged from the vessel 6.

The compressing portion 7 of the screw conveyor 10 consists of a continuous screw thread in which the space for the pulp is successively reduced to an outlet 9. In view of the fact that a pulp plug is formed by the screw thread, the feeding out of the pulp plug through outlet 9 occurs in an air-tight manner, so that the pressure within the vessel 6 can be maintained. The open portion 8 of the screw conveyor 10 preferably consists of a partially open or discontinuous thread, such as a strip thread, which leaves an axial passage adjacent to the screw axle open therethrough for the passage of steam. A steam outlet 5 is connected to this portion of the vessel 6. The steam outlet 5 is coupled to the preheater 1 so that the steam can be utilized for the preheating of the chips. The screw conveyor 10 also maintains the interior of the vessel 6 free from fiber accumulation and coatings. The vessel 6 preferably is positioned horizontally, which, among other things, provides installation advantages, because the amount of vertical space used can thus be restricted. Vertical positioning or inclination of the vessel 6 between 0° and 90°, is also possible, in which case the steam outlet 5 would be placed upwardly, and the pulp outlet 9 placed downwardly.

The flow resistance in the blow pipe 3 must be low, i.e., the pipe should, therefore, not have unnecessary vents, curves or level differences. In this manner, the pulp and steam can flow from the grinding housing to the steam separator 4 with a very low pressure drop. By arranging the vessel 6 horizontally, the blow pipe 3 can be short, straight and horizontal, which means that the discharge of pulp from the vessel 6 will be located on about the same level as the defibrator. Since the required vertical space can be restricted in this type of installation, there is no need for pumps and additional conduits for the purpose of lifting the pulp from a lower level to a higher level. In view thereof, considerable advantages are realized in this installation, since the defibrator is the type of apparatus which is generally located at ground level, since it requires a very rigid base.

Transfer of the separated steam through the steam passage 5 to the preheater 1 also requires a very low pressure drop, since no fibrous material is to be carried therethrough.

It has surprisingly been found that the steam pressure generated in the defibrator can be utilized to pressurize the entire system, and at the same time obtain steam flow from the defibrator via the steam separator to the preheater without the use of any fans or compressors. There is also no need for the use of a substantially pressure-proof feeder to the defibrator, and an ordinary conveying screw can be used instead. It is thus sufficient if the flow resistance for the steam through the conveying screw is higher than the flow resistance through the blow pipe and the steam passage.

When the amount of generated steam exceeds that amount required for maintaining the pressure in the system, preferably 5–12 bar, excess steam can be discharged, for example, through the top of the preheater 1. In other cases, fresh steam can be added to the grinding housing of the defibrator 2.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for the manufacture of pulp fiber from lignocellulose-containing material comprising a preheater for preheating said lignocellulose-containing material, a defibrator including a pressurized housing for defibrating said preheated lignocellulose-containing material to produce defibrated lignocellulose-containing material and steam therein, conveying means for conveying said preheated lignocellulose-containing material from said preheated to said defibrator at a first predetermined flow resistance, a horizontal separator comprising an air-tight separator housing extending substantially horizontally for separating said steam from said defibrated lignocellulose-containing material, a blow pipe at a second predetermined flow resistance for transferring said defibrated lignocellulose-containing material and said steam from said defibrator to said horizontal separator, said horizontal separator including a pulp outlet, a steam outlet and screw conveyor means having a screw axis and including screw threads for feeding said defibrated lignocellulose-containing material from said blow pipe to said pulp outlet in the form of a pulp plug so as to maintain the pressure within said horizontal separator; said blow pipe entering said horizontal separator at a predetermined angle with said screw axis and said screw thread having a screw thread angle which substantially forms the same angle with the screw axis as said predetermined angle, and steam transfer means at a third predetermined flow resistance for transferring said separated steam from said steam outlet to said preheater for preheating said lignocellulose-containing material therewith, said second and third predetermined flow resistances being less than said first predetermined flow resistance whereby said steam flows from said defibrator to said horizontal separator and said preheater.

2. The apparatus of claim 1 wherein said preheater is substantially vertical, and has an upper end and a lower end, said preheater including a feed input at said upper end for feeding said lignocellulose-containing material thereinto, said conveying means being located at said lower end of said preheater.

3. The apparatus of claim 2 wherein said perheater has an input and said steam transfer means transfers said separated steam to said feed input of said preheater.

4. The apparatus of claim 1 wherein said defibrator is located adjacent to said horizontal separator.

5. The apparatus of claim 4 wherein said blow pipe is substantially linear so as to minimize said second predetermined flow resistance.

* * * * *

UNITED STATES PATENT AND TRADEMARK OFFICE

CERTIFICATE OF CORRECTION

PATENT NO. : 5,034,099

DATED : July 23, 1991

INVENTOR(S) : Kjell R. S. Nilsson

It is certified that error appears in the above-identified patent and that said Letters Patent is hereby corrected as shown below:

Column 5, line 16, "preheated" should read --preheater--.

Signed and Sealed this

Ninth Day of February, 1993

*Attest:*

STEPHEN G. KUNIN

*Attesting Officer*

*Acting Commissioner of Patents and Trademarks*